US010030674B2

(12) United States Patent
Cox et al.

(10) Patent No.: US 10,030,674 B2
(45) Date of Patent: Jul. 24, 2018

(54) STERILE LIQUID PUMP WITH SINGLE USE ELEMENTS

(71) Applicants: C. Anthony Cox, Colleyville, TX (US); James A. Austin, Forth Worth, TX (US)

(72) Inventors: C. Anthony Cox, Colleyville, TX (US); James A. Austin, Forth Worth, TX (US)

( * ) Notice: Subject to any disclaimer, the term of this patent is extended or adjusted under 35 U.S.C. 154(b) by 259 days.

(21) Appl. No.: 14/961,083

(22) Filed: Dec. 7, 2015

(65) Prior Publication Data

US 2016/0312804 A1 Oct. 27, 2016

Related U.S. Application Data

(63) Continuation-in-part of application No. 14/693,595, filed on Apr. 22, 2015, now Pat. No. 9,765,769.

(51) Int. Cl.

| | |
|---|---|
| ***F04F 1/02*** | (2006.01) |
| ***F04B 9/12*** | (2006.01) |
| ***F04B 9/129*** | (2006.01) |
| ***F04B 53/16*** | (2006.01) |

(52) U.S. Cl.

CPC ..... *F04F 1/02* (2013.01); *F04B 9/1207* (2013.01); *F04B 9/1295* (2013.01); *F04B 53/16* (2013.01)

(58) Field of Classification Search

CPC ..... F04F 1/02; F04F 1/10; F04F 1/12; F04F 1/06; B67D 1/08; B67D 1/108; B67D 1/11; B65D 35/22; B65D 35/242; C12M 29/00; C12M 29/02; C12M 29/10; C12M 29/12; C12M 29/14; C12M 45/02; C12M 1/02; Y10T 137/86083

USPC ..... 210/340–341, 416.1, 102, 114, 116, 134; 366/163.1, 177.1, 181.8, 182.2; 222/394, 222/399

See application file for complete search history.

(56) References Cited

U.S. PATENT DOCUMENTS

| | | | | |
|---|---|---|---|---|
| 975 | A | 1/1809 | Upham | |
| 8,834 | A | 5/1835 | Curtis | |
| 104,301 | A | 6/1870 | Gruber | |
| 992,711 | A | 5/1911 | Freeman | |
| 2,669,941 | A | 2/1954 | Stafford | |
| 5,749,711 | A | 5/1998 | Park | |
| 6,200,104 | B1 | 3/2001 | Park | |
| 6,368,067 | B1 * | 4/2002 | Stutz | F04F 1/06 417/118 |
| 6,623,248 | B1 | 9/2003 | Dusemund et al. | |

(Continued)

*Primary Examiner* — Kenneth J Hansen
(74) *Attorney, Agent, or Firm* — Dan Brown Law Office; Daniel R. Brown

(57) ABSTRACT

A sterile liquid pump, having replaceable single use components, with a first and second chamber, and a gas valve assembly to selectively communicate gas pressure and vacuum with the chambers, and a resilient tubing liquid manifold loop with a sequence of four ports located within a manifold receiver that supports four pinch actuators aligned to engage and selectively pinch-off flow through the manifold between adjacent pairs ports, and, a controller that operates the valve assembly to alternatingly couple pressure and vacuum to the pump chambers, and that also operates to alternatingly actuate pairs of the pinch actuators to sequentially pump fluid from pump chambers under gas pressure, and through an opposing pair of ports in the resilient tubing manifold.

18 Claims, 12 Drawing Sheets

(56) References Cited

U.S. PATENT DOCUMENTS

| | | | | |
|---|---|---|---|---|
| 2004/0031521 | A1* | 2/2004 | Vrane | F04B 11/0025 137/207 |
| 2006/0196884 | A1* | 9/2006 | Gerken | B67D 7/0272 222/64 |
| 2011/0107582 | A1* | 5/2011 | Frej | B01D 15/18 29/428 |

* cited by examiner

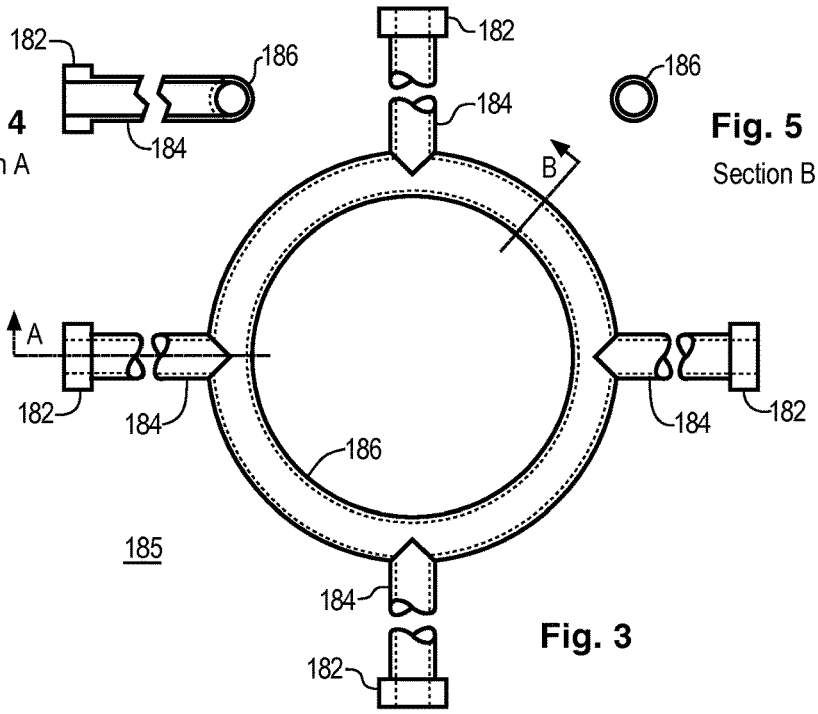
182
186
184
Fig. 4
Section A
182
184
186
Fig. 5
Section B
B
A
182
184
186
184
182
185
184
182
Fig. 3
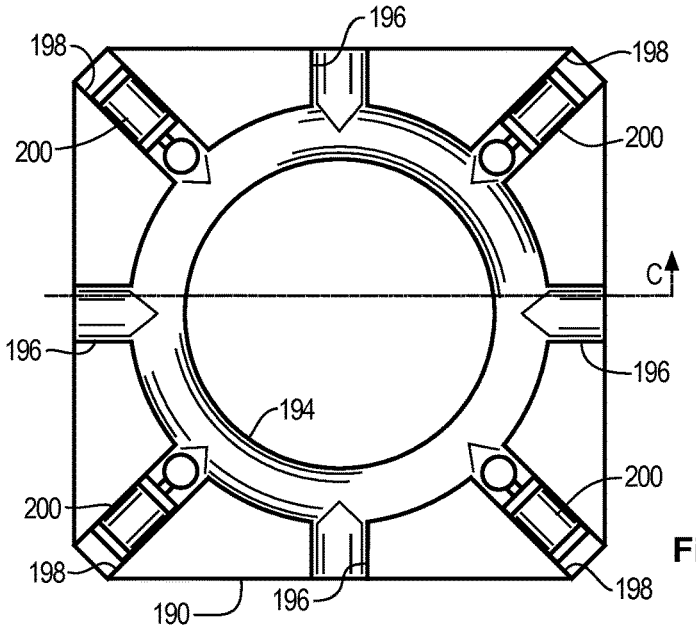
196
198
198
200
200
C
196
196
194
200
200
198
198
190
196
Fig. 6
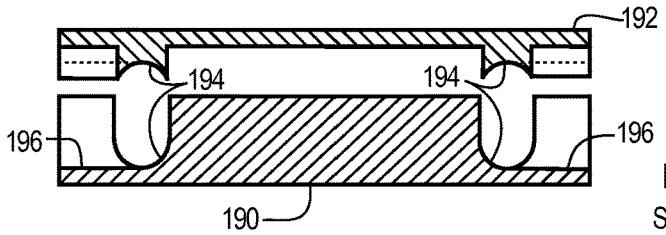
192
194
194
196
196
190
Fig. 7
Section C

| System Operation | Pressure/Vaccum Valves | | | | Liquid Flow Valves | | | |
|---|---|---|---|---|---|---|---|---|
| | P1 | V1 | P2 | V2 | A1 | B1 | A2 | B2 |
| OFF | X | X | X | X | X | X | X | X |
| C1 Fill C2 Pump | X | O | O | X | | | | |
| A Outlet B Outlet | | | | | X O | O X | O X | X O |
| C1 Pump C2 Fill | O | X | X | O | | | | |
| A Outlet B Outlet | | | | | O X | X O | X O | O X |
| Service Replace | X | X | X | X | O | O | O | O |

240 242 244 246 248 250 252 254 Alternate

| System Operation (410) | Pressure/Vaccum Valves (412) | | | | Liquid Check Valves (414) | | | |
|---|---|---|---|---|---|---|---|---|
| | P1 | V1 | P2 | V2 | A1 | B1 | A2 | B2 |
| 416 OFF | X | X | X | X | | | | |
| 418 C1 Fill C2 Pump | X | O | O | X | X | O | O | X |
| 420 C1 Pump C2 Fill | O | X | X | O | O | X | X | O |

422 Alternate

STERILE LIQUID PUMP WITH SINGLE USE ELEMENTS

RELATED APPLICATIONS

This application is a continuation-in-part application of U.S. patent application Ser. No. 14/693,595 filed on Apr. 22, 2015.

BACKGROUND OF THE INVENTION

Field of the Invention

The present invention relates to liquid pumps. More particularly, the present invention relates to gas pressure and vacuum driven liquid pumps suitable for high purity and sterile liquid pumping applications.

Description of the Related Art

In many critical applications, there is a need for liquid transfer where the transferred liquid must be very carefully handled so as not to compromise the purity, physical, chemical, biological, or pharmaceutical characteristics of the liquid. One common issue in such applications is the need to maintain the cleanliness of the pumping equipment, always with an eye on the cost and downtime needed to maintain such equipment. By way of example, the biopharmaceutical industry is shifting to more single use equipment to reduce cost and increase flexibility in the manufacturing processes. Experience in the industry has demonstrated that cleaning and sterilization utilities, as well as validation and maintenance of the systems, are found to be more expensive than operating with single use equipment. With respect to single use pumping equipment, peristaltic pumps have been generally used as single use pumps since the tubing utilized in these pumps can be threaded through the pump head without breaching the sanitary barrier of the tube set. Peristaltic pumps are suitable for rough applications where process flow control is not of critical importance. However, many processes rely on more accurate flow control. Such systems have not yet been fully transitioned into the single use paradigm for this reason alone.

There are a number of other applications for single use pumps in the biopharmaceutical, and other, industries. For example, it is sometimes necessary to circulate liquids stored in a single use vessel, such as a polymeric lined storage vessel. In the prior art, single use mixing vessels have employed impellers within the liner that are driven through the liner by a magnetically coupled drive unit. This approach drives up the cost of the liner and creates material recycling issues with respect to the rare earth materials, such as neodymium, used in the magnet. Shipping liners with impellers inside is a packaging challenge as well. Liners are often found to leak from where the impeller has vibrated against the film.

In other applications, biopharmaceutical pumps need to provide ultra low shear so as to be gentle on sensitive product, provide a turndown greater than 100:1, operate under pressure ranges from 0.01 to over 100 psig, be self priming, provide positive shut-off of process flow, provide bidirectional liquid flow, provide very low pressure pulse and surge flow, and provide a flexible programming interface for processing considerations. Thus it can be appreciated that there is a need in the art for a liquid pump that address these, and other, problems in the prior art.

SUMMARY OF THE INVENTION

The need in the art is addressed by the teaching of the present disclosure. The present disclosure teaches a gas pressure and vacuum driven pump apparatus for pumping a liquid between a first and second process interface. The apparatus includes a first pump chamber with a first gas coupling and a first liquid coupling, and a second pump chamber with a second gas coupling and a second liquid coupling. A gas valve assembly is coupled to selectively communicate gas pressure and vacuum with the first gas coupling and the second gas coupling. A resilient tubing manifold is configured as a loop and has a sequence of ports positioned along the loop, which includes a first liquid port for connection to the first liquid coupling, a first process port for connection to the first process interface, a second liquid port for connection to the second liquid coupling, and a second process port for connection to the second process interface. A manifold receiver is configured to receive the resilient tubing manifold and present the sequence of ports for connection. Four pinch actuators are disposed about the manifold receiver and are aligned to engage and selectively pinch-off flow through the resilient tubing manifold between adjacent pairs of the sequence of ports, which thereby implement four liquid valve functions. A controller is provided, which is programmed to operate the gas valve assembly to alternatingly couple gas pressure and vacuum to the first pump chamber and the second pump chamber in a manner such that one pump chamber is pressurized while the other pump chamber is evacuated. The controller is further programmed to alternatingly actuate the four pinch actuators to open and close pairs of the four liquid valve functions and sequentially fluidly couple either of the first pump chamber or second pump chamber that is pressurized to the first process port, and also sequentially fluidly couple either of the first pump chamber or second pump chamber that is evacuated to the second process port, thereby effecting a flow of the liquid from the second process interface to the first process interface.

In a specific embodiment of the foregoing apparatus, the controller is further programmed to operate the gas valve assembly to precharge the first and second pump chambers with gas pressure prior to each cycle of the program to alternatingly couple gas pressure and vacuum to the first pump chamber and the second pump chamber in a manner such that one pump chamber is pressurized while the other pump chamber is evacuated. In another specific embodiment, the apparatus further includes a gas pressure regulator coupled with the gas valve assembly to deliver regulated gas pressure to precharge the first pump chamber and the second pump chamber.

In a specific embodiment, the foregoing apparatus further includes a first micron filter, which is a sterilization grade filter, that is coupled between the first gas coupling and the gas valve assembly, thereby sterilely isolating the first pump chamber from the gas valve assembly. A similar filter may be added form the second pump chamber.

In a specific embodiment of the foregoing apparatus, wherein the first and second pump chambers are oriented vertically with the first and second gas couplings located at the upper end, and the first and second liquid couplings located at the bottom end of the first and second pump chambers, respectively, the apparatus further includes an upper level detector and a lower level detector positioned adjacent to the upper end and lower end, respectively, of each of the first and second pump chambers to thereby sense the liquid level therein and generate a liquid level signal. The level detectors are coupled to provide the liquid level signals to the controller, and the controller is programmed to alternate the gas pressure and vacuum to the first and second pump chambers, and to alternate the actuation of the pinch actuators according to the liquid level signals, to thereby prevent over filling and under filling of the first and second pump chambers.

In a specific embodiment of the foregoing apparatus, the tubing manifold is fabricated from round elastomeric tubing in a torus configuration with the first and second liquid ports, and the first and second process ports extending radially outward therefrom, and, the manifold receiver includes a torus shaped recess that conforms to the torus configuration to retain the tubing manifold, and includes four port openings for the first and second liquid ports, and the first and second process ports, and includes pinch actuator mounts that accept the four pinch actuators in a manner to enable the four pinch actuators to engage, and pinch-off liquid flow, of the tubing manifold.

In a specific embodiment of the foregoing apparatus, the pinch actuators include a motive mechanism selected from among an air cylinder, a solenoid, and a motor. In another specific embodiment, the controller is programmed to provide an operating mode in which all of the four pinch valves are closed, thereby shutting off liquid flow through the pump apparatus, and, the controller is further programmed to provide an operating mode in which all of the four pinch valves are open, thereby enabling the replacement of the tubing manifold in the manifold receiver.

In a specific embodiment, the foregoing apparatus further includes a mass flow meter disposed adjacent to the first process port, which provides a volumetric flow signal, which is coupled to the processor, and, the processor accumulates the process flow signal to produce an accumulated liquid volume signal.

In a specific embodiment, the foregoing apparatus further includes a gas flow meter coupled with the gas valve assembly, which provides a gas flow signal, the gas flow signal is coupled to the processor, which correlates the gas flow signal with parameters of the liquid being pump to produce a liquid flow signal.

In a specific embodiment of the foregoing apparatus, the controller is programmed to actuate the gas valve assembly to deliver gas pressure to both of the first and second pump chambers, thereby enabling a pressure test of the first and second pump chambers and the tubing manifold. In another specific embodiment, the foregoing apparatus further includes aseptic connectors that terminate the first and second gas couplings, the first and second liquid couplings, the first and second liquid ports, and the first and second process ports.

The present disclosure also teaches a method of pumping a liquid between a first process interface and a second process interface utilizing gas pressure and vacuum in a pump consisting of a first pump chamber with a first gas coupling and a first liquid coupling, and a second pump chamber with a second gas coupling and a second liquid coupling, and a gas valve assembly, and a resilient tubing manifold configured as a loop with a sequence of ports positioned along the loop, including a first liquid port, a first process port, a second liquid port, and a second process port, and a manifold receiver with four pinch actuators disposed about the manifold receiver for engaging the resilient tubing manifold between adjacent pairs of the sequence of ports. The method includes the steps of inserting the tubing manifold into the manifold receiver, and connecting the first liquid port to first liquid coupling, and connecting the second liquid port to the second liquid coupling, and connecting the first process port to the first process interface, and connecting the second process port to the second process interface. Then, selectively operating the gas valve assembly to alternatingly couple gas pressure and vacuum to the first gas coupling of first pump chamber and the second gas coupling of the second pump chamber in a manner alternatingly pressurizing one pump chamber while evacuating the other pump chamber. And, simultaneously selectively actuating the four pinch actuators, thereby engaging and selectively pinching-off flow through the resilient tubing manifold between adjacent pairs of the sequence of ports and thereby implementing liquid valve functionality, and opening and closing pairs of the four liquid valve functions and sequentially fluidly coupling either of the first pump chamber or second pump chamber that is pressurized to the first process port, and also sequentially fluidly coupling either of the first pump chamber or second pump chamber that is evacuated to the second process port, thereby effecting a flow of the liquid from the second process interface to the first process interface.

In a specific embodiment, the foregoing method includes the further step of selectively operating the valve assembly to precharge the first and second pump chambers with gas pressure prior to each cycle of the step of selectively operating the gas valve assembly to alternatingly couple gas pressure and vacuum to the first gas coupling of first pump chamber and the second gas coupling of the second pump chamber in a manner alternatingly pressurizing one pump chamber while evacuating the other pump chamber.

In a specific embodiment, the foregoing method further includes the steps of coupling a first micron filter, which is a sterilization grade filter, between the first gas coupling and the gas valve assembly, thereby sterilely isolating the first pump chamber from the gas valve assembly.

In a specific embodiment of the foregoing method, where the first and second pump chambers are oriented vertically with the first and second gas couplings located at the upper end, and the first and second liquid couplings located at the bottom end of the first and second pump chambers, respectively, and further including an upper level detector and a lower level detector positioned adjacent to the upper end and lower end, respectively, of each of the first and second pump chambers, thereby sensing the liquid level therein, and generating a liquid level signal, the method further includes the steps of alternating the gas pressure and vacuum coupled to the first and second pump chambers according to the liquid level signal, and alternating the actuation of the pinch actuators according to the liquid level signals, thereby preventing over filling and under filling of the first and second pump chambers.

In a specific embodiment, the foregoing method further includes the steps of implementing a pump-off mode of operation by simultaneously pinching off all of the four pinch actuators, thereby shutting off liquid flow through the pump, and also implementing an open-mode of operation by simultaneously opening all for of the pinch actuators, thereby enabling the replacement of the tubing manifold in the manifold receiver.

In a specific embodiment of the foregoing method, wherein a mass flow meter is disposed adjacent to the first process port, which provides a volumetric flow signal, the method further includes the steps of accumulating the volumetric flow signal into an accumulated liquid volume signal.

In a specific embodiment, the foregoing method further includes the steps of actuating the gas valve assembly to deliver gas pressure to both of the first and second pump chambers, thereby enabling a pressure test of the first and second pump chambers and the tubing manifold.

In a specific embodiment, wherein a gas flow meter is coupled with the gas valve assembly for providing a gas flow signal, the foregoing method further includes the steps of correlating the gas flow signal with parameters of the liquid being pump, and producing a correlated liquid flow signal.

In a specific embodiment, the foregoing method further includes the steps of terminating the first and second gas couplings, the first and second liquid couplings, the first and second liquid ports, and the first and second process ports with aseptic connectors, thereby enabling the sterile replacement of the first and second pump chambers and the tubing manifold.

The present disclosure also teaches a gas pressure and vacuum driven pump for pumping a liquid from a liquid inlet coupling to a liquid outlet coupling of an external process. The pump includes a first pump chamber with a first gas coupling and a first liquid coupling, and a second pump chamber having a second gas coupling and a second liquid coupling. A gas valve assembly selectively communicates gas pressure or vacuum with the first gas coupling and the second gas coupling. A liquid manifold, which includes a liquid inlet port for connection to the process liquid inlet coupling and a liquid outlet port for connection to the process liquid outlet coupling, wherein the liquid inlet port is directionally coupled to a first liquid port by a first inlet check valve and directionally coupled to a second liquid port by a second inlet check valve. The first liquid port is coupled to the liquid outlet port by a first outlet check valve, wherein the second liquid port is directionally coupled to the liquid outlet port by a second outlet check valve, and, the first inlet port is coupled to the first liquid coupling and the second liquid port is coupled to the second liquid coupling. A controller is programmed to actuate the gas valve assembly to alternatingly couple gas pressure or vacuum to the first gas coupling and the second gas coupling such that one of the first and second pump chambers is pressurized while the other pump chamber is evacuated. Vacuum that is applied to the first pump chamber draws liquid from the liquid inlet coupling, through the liquid inlet port, through the first inlet check valve, through the first liquid port and into the first pump chamber, while gas pressure coupled to the second pump chamber pushes liquid out of the second pump chamber, through the second liquid port, through the second outlet check valve, out the liquid outlet port, and into the liquid outlet coupling. Further, and alternatingly, vacuum that is applied to the second pump chamber draws liquid from the liquid inlet coupling, through the liquid inlet port, through the second inlet check valve, through the second liquid port, and into the second pump chamber, while gas pressure coupled to the first pump chamber pushes liquid out of the first second pump chamber, through the first liquid port, through the first outlet check valve, out the liquid outlet port, and into the liquid outlet coupling, to thereby effect a flow of the liquid from the liquid inlet coupling to the liquid outlet coupling.

The present disclosure further teaches a method of pumping a liquid between a liquid inlet coupling and a liquid outlet coupling of an external process utilizing gas pressure and vacuum in a pump consisting of a first pump chamber with a first gas coupling and a first liquid coupling, and a second pump chamber with a second gas coupling and a second liquid coupling, and a gas valve assembly coupled to a controller, and a liquid manifold with a liquid inlet port and a liquid outlet port where the liquid inlet port is directionally coupled to a first liquid port by a first inlet check valve and directionally coupled to a second liquid port by a second inlet check valve, and where the first liquid port is coupled to the liquid outlet port by a first outlet check valve, and wherein the second liquid port is directionally coupled to the liquid outlet port by a second outlet check valve. The method includes the steps of connecting the first pump chamber and the second pump chamber to the gas valve assembly, and coupling the liquid manifold to the pump by connecting the liquid inlet port to the liquid inlet coupling, connecting the liquid outlet port to the liquid outlet coupling, connecting the first liquid port to the first liquid coupling, and connecting the second liquid port to the second liquid coupling, and, controlling the gas valve assembly to alternatingly couple gas pressure or vacuum to the first gas coupling and the second gas coupling thereby pressurizing one of the first and second pump chambers while evacuating the other pump chamber, and thereby drawing liquid from the liquid inlet coupling, through the liquid inlet port, through the first inlet check valve, through the first liquid port and into the first pump chamber by applying vacuum to the first pump chamber, while pushing liquid out of the second pump chamber, through the second liquid port, through the second outlet check valve, out the liquid outlet port, and into the liquid outlet coupling by applying gas pressure to the second pump chamber, and alternatingly, applying vacuum to the second pump chamber, thereby drawing liquid from the liquid inlet coupling, through the liquid inlet port, through the second inlet check valve, through the second liquid port, and into the second pump chamber, while applying gas pressure to the first pump chamber, thereby pushing liquid out of the first second pump chamber, through the first liquid port, through the first outlet check valve, out the liquid outlet port, and into the liquid outlet coupling, and, the method thereby effecting a continuous flow of the liquid from the liquid inlet coupling to the liquid outlet coupling.

BRIEF DESCRIPTION OF THE DRAWINGS

FIG. 3 is a top view drawing of a resilient tubing manifold according to an illustrative embodiment of the present invention.

FIG. 4 is a section view of a resilient tubing manifold port extension according to an illustrative embodiment of the present invention.

FIG. 5 is a section view of a resilient tubing manifold according to an illustrative embodiment of the present invention.

FIG. 6 is a drawing of a manifold receiver according to an illustrative embodiment of the present invention.

FIG. 7 is a section view drawing of a manifold receiver according to an illustrative embodiment of the present invention.

DESCRIPTION OF THE INVENTION

Figure 1:
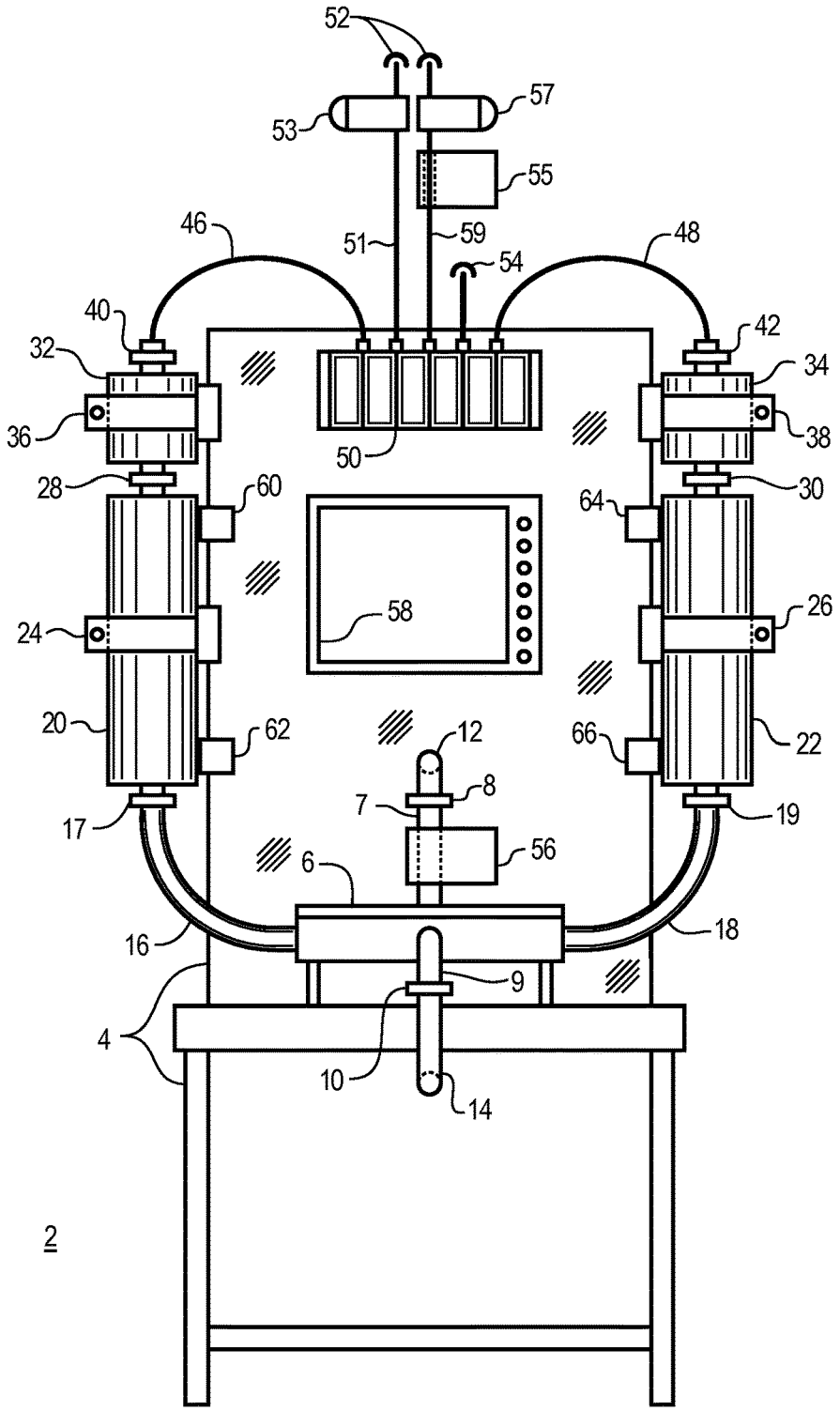
FIG. 1 is a front view drawing of a pump according to an illustrative embodiment of the present invention.

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope hereof, and additional fields in which the present invention would be of significant utility. The apparatus and system components and method steps have been represented where appropriate by conventional symbols in the drawings, showing only those specific details that are pertinent to understanding the present invention so as not to obscure the disclosure with details that will be readily apparent to those of ordinary skill in the art having the benefit of the disclosures contained herein.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular exemplary embodiments only and is not intended to be limiting. As used herein, the singular forms "a", "an", and "the" may be intended to include the plural forms as well, unless the context clearly indicates otherwise. The terms "comprises", "comprising", "including", and "having", are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged with", "connected to", or "coupled to" another element or layer, it may be directly on, engaged, connected, or coupled to the other element or layer, or intervening elements or layers may be present. In contrast, when an element is referred to as being "directly on", "directly engaged with", "directly connected to", or "directly coupled to" another element or layer, there may be no intervening elements or layers present. Other words used to describe the relationship between elements should be interpreted in a like fashion (e.g., "between" versus "directly between", "adjacent" versus "directly adjacent", etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first", "second", and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner", "outer", "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

An illustrative embodiment of the present invention is applied to the biopharmaceutical industries. As discussed hereinbefore, there is a trend toward single use components as opposed to cleaning and sterilization of elements that physically engage a process liquid. This trend is cost driven. Single use also lends itself to increased flexibility in the manufacturing and processing plants. Cleaning and sterilization processes, as well as confirmation and maintenance, are frequently more expensive than operating with single use equipment. However, single use pumps can be applied to any industry where pumping liquids or solids of various types are required. The single use pumps of the present disclosure comprise various desirable performance attributes including the following partial list.

- Ultra low shear—gentle on sensitive product
- High turndown—greater than 100:1 turndown ratio
- Wide operating pressure range—0.01 to over 100 psig
- Positive self priming—up to 30 feet
- Highly accurate flow rate control
- Positive shut off—no liquid flow through the pump when stopped
- No internal rotating parts
- No mechanical seals
- Low pressure pulse frequency
- Forward or reverse operation
- Purge pump chambers and line forward to approximately 99% free of product
- Simple to operate
- Quiet Fully programmable pumping operation—can interface with existing control systems Single use does not apply to the entire pump assembly, but rather single use of those components that are in contact with the process liquids, or that present a risk of contamination to the process liquids or other components that would require sanitization or sterilization.

An illustrative embodiment of the present disclosure describes a pump that runs on pressurized gas and vacuum sources, which are provided from systems outside of the pump itself. Gas pressure and vacuum sources are commonly present in production facilities. Air is one choice for the pressurized gas, however, certain processes may require other gasses, such as inert nitrogen, for example. The vacuum is applied to the top of each of two pump chambers in a priming step to at least partially fill the pumping chambers with process liquid from a lower liquid inlet. Liquid fills through the lower liquid inlet until a high level detector indicates that the pump chambers are full. The level switches are used to shut off the vacuum source and close a liquid inlet valve to each pump chamber. Then, compressed gas begins to pressurize the pump chambers through a top gas inlet to the set system pressure. The pressure on the pump chambers enables the pumping process to begin. Control valves are used to route the gas pressure and vacuum to the pump chambers, and in certain embodiments it is useful to pre-charge the gas pressure prior to opening the liquid valves to being the pump action. This enables precise control of pumping pressures and also facilities more accurate flow measurement.

Pumping is commenced by opening a liquid valve coupled to the bottom of a first pump chamber, while the pressure at the top urges the liquid out of that pump chamber. The second pump chamber is idle until the liquid level in the first pump chamber reaches a low level. Once the low level is achieved in the first pump chamber, the bottom liquid valve and compressed gas source close, and simultaneously the second pump chamber liquid outlet is opened. The first pump chamber vacuum cycle begins to fill that pump chamber by simultaneously opening the bottom liquid inlet flow path and opening the vacuum source to that pump chamber. For continuous operation, the filling pump chamber must fill faster than the emptying pump chamber empties. This sets the maximum flow rate achievable for the system, and also provides time for the gas pressure pre-charging mentioned above. It is also useful to employ precision pressure regulators, such as electronically controlled pressure regulators, as are known to those skilled in the art.

The gas pressure and vacuum flow paths are controlled by suitable gas valves, which are isolated from the process liquid using sterilization grade micron filters, and as such are not in the sterile material circuit in the illustrative embodiment. The liquid valve arrangement in the illustrative embodiment is a resilient tubing manifold, which has four ports for connecting to the two pump chambers, as well as the process input and output connections. The tubing manifold is formed as a loop, and may be configured as a torus shape, which may also be referred to as a donut. The four ports extend out of the donut. Valve action for the liquid paths is accomplished by pinching the donut in coordinated fashion at location between adjacent ports to implement the valve functions. Pinch actuators are employed to achieve the pinching action.

The resilient tubing manifold is within the sterile liquid path, and as such, is a single use item. The pump chambers are also in the sterile liquid path. Connections to the ports may be facilitated using commercial aseptic connectors, as are known in the art. Flow control may be managed through the use of a mass flow controller on the gas supply to the chambers, or the use of flow meters on the within the liquid circuit. The gas flow controller enables a system controller to monitor and control actual gas flow pushing the liquid product through the system. And, this is accomplished without any penetration of the single use sanitary tubing components. In an illustrative embodiment, the pump components comprise the following items.

Control cabinet
DC Power Supply
Mass flow meter
PLC (programmable logic controller) with user interface
Bank of solenoid valves
Sterilizing grade 0.2 micron filters
Pump chambers
Four non-contact liquid level sensors
Inlet and outlet sanitary ferrules set at the top and bottom of each vessel
Four pinch actuators in a manifold receiver
A donut shaped resilient tube manifold with four radial ports In addition to the aforementioned pumping operations of the illustrative embodiment pump, the fully assembled pump has several other operation steps that can be programmed into the PLC. These comprise the following list of item.

Pressure testing—test critical flow path set up prior to pumping
Priming operation—fill with process liquid prior to pumping
Pumping operation—full control and monitoring of fluid flow.
Pump pressure monitoring
Flow rate monitoring and volume totalizing
Reversible pump flow directions
Pump chamber liquid line purging With regard to flow control and monitoring, flow control is accomplished using a mass flow controller placed inline of the gas flow path in the control cabinet, which is not part of the sterile system. Mass flow controllers are well known in the art. Further, sterilizing grade 0.2 micron filters are placed on the pump chambers to maintain pump sterility post gamma sterilization. The flow controller is then be controlled by a programmable set point in the PLC. The flow meters monitor flow rate, and flow totals.

Reference is directed to FIG. 1, which is a front view drawing of a pump assembly 2 according to an illustrative embodiment of the present invention. A stainless steel frame 4 supports the various components, which will now be described. A manifold receiver 6 encloses resilient tubing loop (not shown), which has four ports extending therefrom in the form of resilient tubes, which include a first process interface port 7, a second process interface port 9, a first liquid port 16, and a second liquid port 18. The first process port 7 passes through a flow meter 56, which may be a magnetic or ultrasonic flow meter for example, and is coupled to a first process interface 12 through a coupling 8. The second process interface port 9 is coupled to a second process interface 14 though a coupling 10. The pump assembly 2 generally functions to pump liquid in either direction between the first process interface 12 and the second process interface 14, the flow rate and volume may determined by the flow meter 56, which determination may also consider the physical characteristics of the liquid being pumped.

The pump assembly 2 in FIG. 1 also comprises a first pump chamber 20 and a second pump chamber 22, each having a bottom liquid coupling 17, 19, respectively, and top gas couplings 28, 30, respectively. The bottom liquid couplings 17, 19 are connected to the first and second liquid ports 16, 18, respectively. In the illustrative embodiment, the pump chambers 20, 22 are fabricated from PVDF (polyvinylidene fluoride) thermoplastic configured as 4" by 12" cylinders having a volume of approximate two liters each. The first and second pump chambers 20, 22 are replaceably supported from the frame 4 using a suitable mounting bracket 24, 26, respectively. Above each pump chamber 20, 22 are corresponding sterilizing filter 32, 34, respectively, which are connected using corresponding couplings 28, 30. In the illustrative embodiment, the sterilizing filters 32, 34 are 0.2 micro filters, which serve the purpose of sterilely isolating the liquid pumped in the chambers 20, 24 from gas and vacuum sources, which will be described hereinafter. The sterilizing filters 32, 34 are replaceably supported from the frame 4 using a suitable mounting bracket 36, 38, respectively.

The pump assembly 2 in FIG. 1 is connected to a gas pressure source 52 and a vacuum source 54, which are provided from separate systems, as are commonly available in biopharmaceutical facilities. These provide a motive force for operation of the pump assembly 2, in addition to electric power (not shown). A pneumatic valve manifold 50 comprises six individual valves that interface by a manifold and selectively couple the gas pressure source 52 and vacuum source 54 with the sterilizing filter 32, 34 though gas tubing 46 and vacuum tubing 48 through corresponding couplings 40, 42. The gas pressure source is provided to the manifold 50 through two conduits 51, 59, and each conduit includes an electronic pressure regulator 53, 57, respectively, which are used to precisely control the gas pressure delivered to the manifold 50. There are two pressure conduits, two regulators and four valves dedicated to pressure delivery so that precise pressure pre-charge and precise pressure pumping actions can be individually implemented by the process controller 58. The pre-charge action brings the pump chambers 20, 22 to the desired system pressure prior to opening the corresponding liquid valve, at which time the pumping pressure us simultaneously applied. The pumping gas flow is measured by mass flow controller 55 on the pumping gas pressure line 59. The pre-charge action eliminates pressure fluctuations that may detrimentally affect gas flow measurements. Thus, the mass flow meter 55 is provided to monitor the volume of pressurized gas consumed during operation of the pump assembly 2. This gas volume can be correlated to the volume of liquid pumped by the pump assembly 2. With respect to the various couplings utilizes in the pump assembly, suitable sanitary fittings are know to those skilled in the art, and aseptic fitting are useful for maintaining sterile connections to avoid any contamination of the liquid being pumped.

Control of the pump assembly 2 in FIG. 1, as well as interface to related processes, is implemented using a programmable logic controller (PLC) 58, as are known to those skilled in the art. The PLC 58 is interfaced to various controls and actuators, including the mass flow controller 55, electronic pressure regulators 53, 57, liquid flow meter 56, solenoids in valve manifold 50, and pinch valve actuators (not shown) located in the manifold receiver 6. In addition, high and low level sensors 60, 62, 64, and 66 are interfaced to the PLC 58. The level detectors are non-contact type, which indicate when the pump chambers 20, 22 either nearly full (upper sensors 60, 64), or nearly empty (lower sensors 62, 66). It is detection of the fill levels that is used by the PLC to determine when the various valves should be switched to control the pumping action. This will be more fully developed hereinafter.

Figure 2:
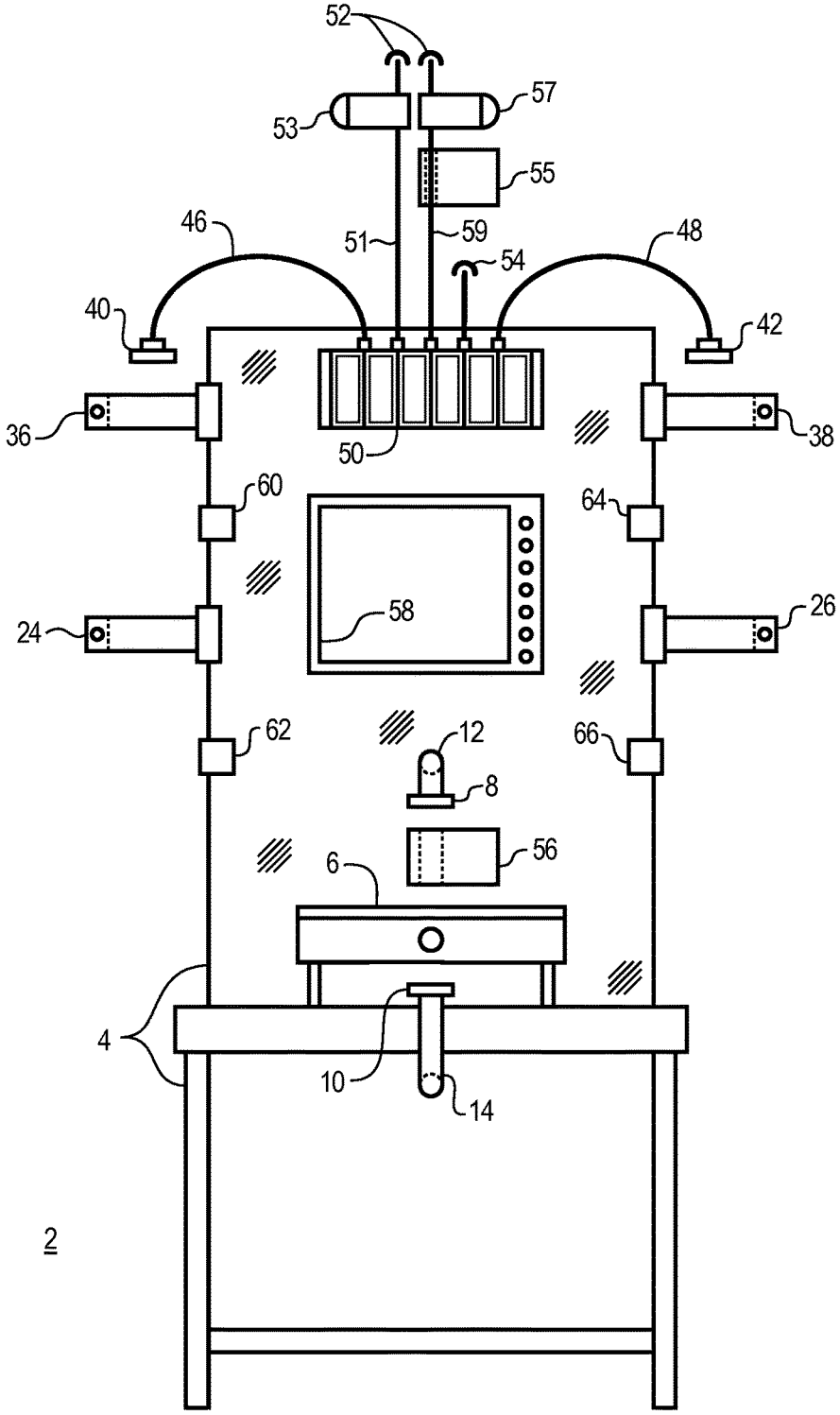
FIG. 2 is a front view drawing of a pump with single use elements removed according to an illustrative embodiment of the present invention.

Reference is directed to FIG. 2, which is a front view drawing of a pump assembly 2 with several single use elements removed, and, according to an illustrative embodiment of the present invention. FIG. 2 generally corresponds with FIG. 1. In FIG. 2, certain advantages of the illustrative embodiment are presented. As was discussed hereinbefore, there are advantages to replacing single use components to maintain sanitation, purity, and sterility, rather than cleaning and testing components prior to reuse. In the case of this illustrative embodiment, all of the elements shown in FIG. 2 are also present in FIG. 1. The elements omitted in FIG. 2 fall within the classification of single use, or replaceable components. These include all of the elements that come into contact with process liquid being pumped by the pump assembly 2. The omitted elements are the resilient tubing manifold and port extensions, the pump chambers, and the sterilization filters. Note that the process liquid interfaces 12, 14 remain, and are otherwise maintained in a suitably sterile and uncontaminated fashion, such as by using aseptic couplers 8, 10, or by other means known to those skilled in the art. The manifold receiver 6 remains because the process liquid never directly contacts this component. Similarly, the liquid flow meter 56 remains because it functions by inserting the replaceable tubing of the resilient manifold into it. Note also that since the four level detectors 60, 62, 64, and 66 are of the non-contact variety, they also remain. Liquid levels are detected through the walls of the pump chambers (which have been removed in FIG. 2) using non-contact level detectors, as are known to those skilled in the art. Also, the gas pressure tube 46 and coupler 40, as well as the vacuum tube 48 and coupler 42, are isolated for sterilization and contamination purposes by the removed micron filters (not shown).

Reference is directed to FIG. 3, which is a top view drawing of a resilient tubing manifold 185 according to an illustrative embodiment of the present invention. Resilient tubing is employed because the manifold 185 is pinched closed to implement valve functionality by pinch actuators (not shown). The resilience of the tubing enables the flow path to reopen after it has been pinched shut. The choice of tubing material is dependent upon the application, including the chemical inertness requirements of the tubing, the nature of the liquid that is to be pumped, the temperature of the pumping system during operation, the pressure and vacuum levels involved in the pumping process, and the requisite flow rates. Silicone tubing is one option, but there is a wide range of resilient tubing materials available, as will be appreciated by those skilled in the art. The tubing is formed into a loop 186 that presents a continuous path for the flow of liquid inside. In the illustrative embodiment, the tubing loop 186 has a circular cross section, as illustrated in FIG. 5, taken as a cross section from FIG. 3. However, other cross section shapes could be employed. Furthermore, while the loop 186 is circular in this illustrative embodiment, it could also be formed as other geometric shapes, such as ovals, ellipses, squares, rectangles, or other shapes. The only requirement is that the loop provides a continuous path to the flow of liquid therein, and that the cross section enables closure in a valve function when driven by a pinch actuator.

The resilient tubing manifold 185 in FIG. 3 includes four ports 184 extending from the loop 186. The ports 184 take the form of tubing extending out from the loop 186. In the illustrative embodiment, the ports extend radially, however, the parts could extend in any desirable direction. Note that there is an open passage for the flow of liquid between the loop 186 and each of the four ports 184, as illustrated in FIG. 4, which is a cross section taken from FIG. 3. Note that each port is terminated with a coupling 182, which is useful for connecting the ports 184 with other process connections. Various couplings could be employed, such as cut tubing terminations, hose barbs, threads, flanges, quick couplers, aseptic couplers, or other couplings as are known to those skilled in the art. Also note that the length of the ports 184 is selected to address the requirements of the system installation, and may be as long as is required to reach various system connections.

Reference is directed to FIG. 6, which is a drawing of a manifold receiver 190 according to an illustrative embodiment of the present invention. The receiver 190 serves to receive, retain, and support the resilient tubing manifold (not shown), and also serves to provide access to the resilient tubing manifold (not shown) for implementation of valve functionality through the use of four pinch actuators 200. In the illustrative embodiment, the receiver 190 is formed from a suitable material, such as nylon, Delrin, other thermoplastics, metal, or composite materials. There is a conformal recess 194 that is adapted to match the shape of the manifold (not shown), which also includes four radial recesses 196 that are adapted to match the ports (not shown). In addition, there are four recesses 198 formed to retain corresponding pinch actuators 200, and which enable the pinch actuators 200 to engage the loop (not shown). FIG. 7 is a cross section taken from FIG. 6, and in FIG. 7 the receiver cover 192 is illustrated. Note that the cross section of the receiver 190 and cover 192 define recesses that conform to the cross section of the resilient tubing manifold (not shown), and this is true form both the loop recess 194 and port recesses 196. This arrangement provides good support form the manifold against high pressures.

Figure 8:
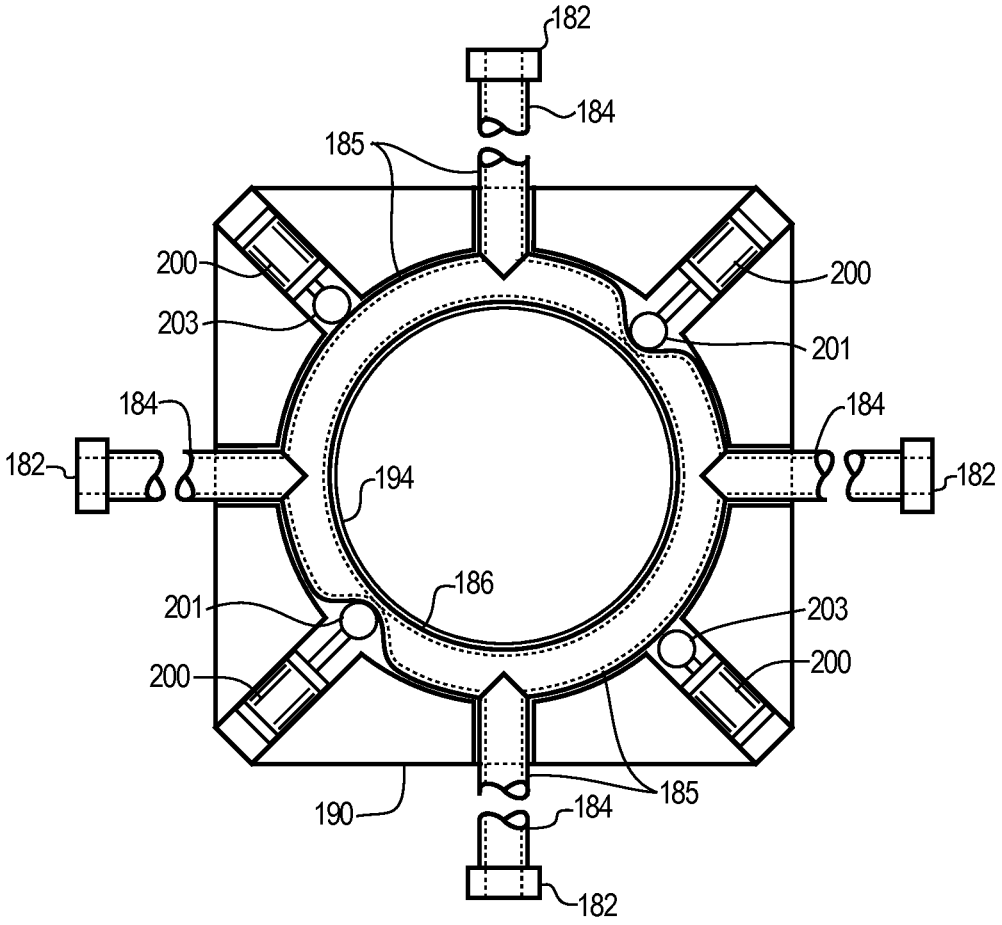
FIG. 8 is a drawing of a resilient tubing manifold inserted into a manifold receiver according to an illustrative embodiment of the present invention.

Reference is directed to FIG. 8, which is a drawing of a resilient tubing manifold 185 inserted into a manifold receiver 190 according to an illustrative embodiment of the present invention. FIG. 8 generally comports with FIGS. 3 through 7, and FIG. 8 particularly illustrates the valve function in this illustrative embodiment. The four pinch actuators 200 are disposed about the manifold loop 186 between adjacent ports 184. In FIG. 8 two of the pinch actuators 200 are extended 201 to pinch-off the loops 186 in a closed valve function. The other two pinch actuators 200 are retracted 203 in an open valve function. In this illustrative embodiment, the pinch actuators 200 are pneumatic cylinders.

Figure 9:
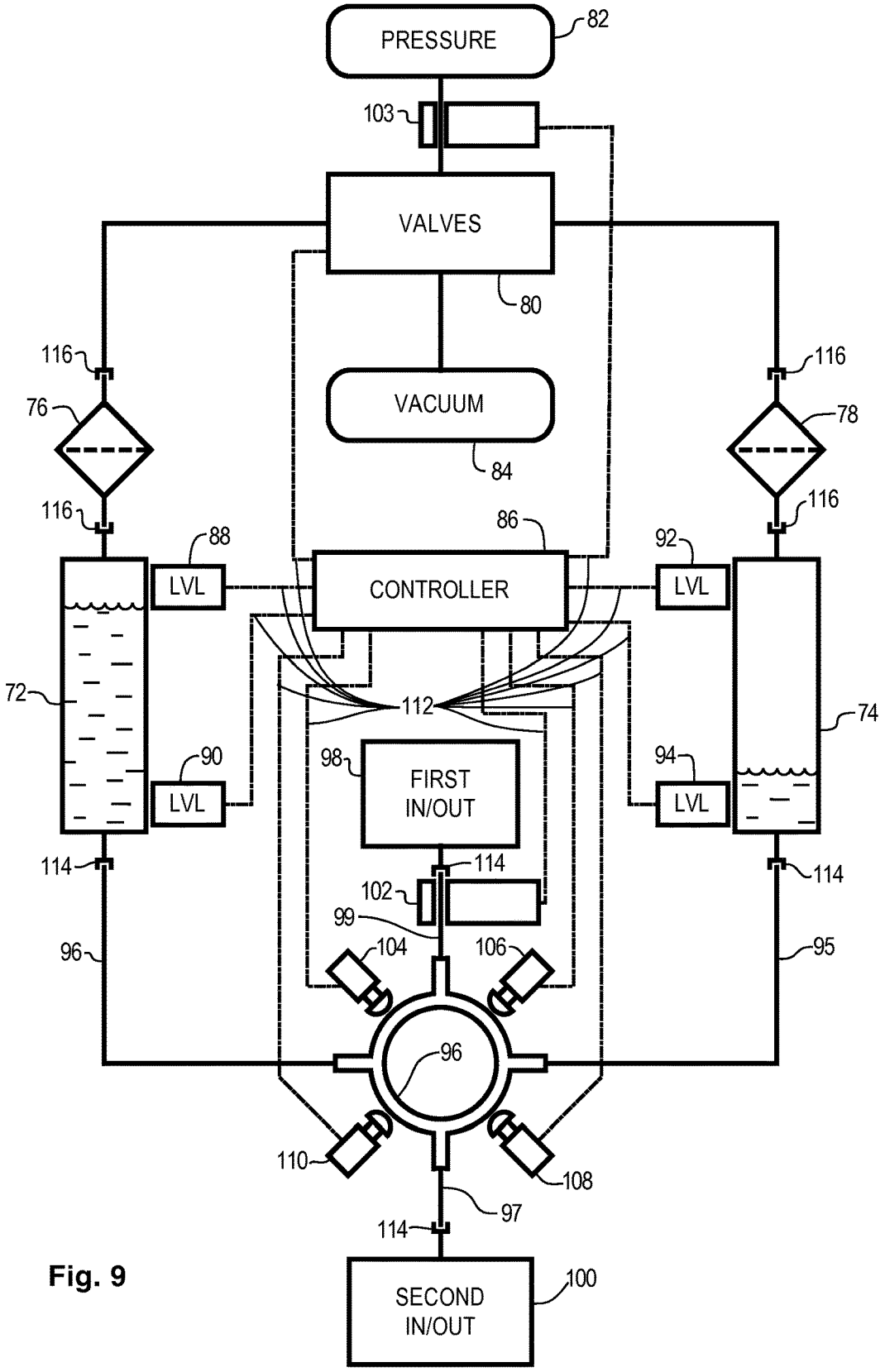
FIG. 9 is a functional block diagram of a pump according to an illustrative embodiment of the present invention.

Reference is directed to FIG. 9, which is a functional block diagram of a pump according to an illustrative embodiment of the present invention. This illustrative embodiment presents a system level view that integrates more details of one implementation of the present invention. A resilient tubing manifold 96 is in position with four pinch actuators 104, 106, 108, and 110, which are operated through one of several controls lines 112 by a programmable controller 86. The manifold 96 comprises four ports, 95, 96, 97, and 99. A first port 99 is coupled to a first process input of output 98, and, a second port 97 is coupled to a second process input or output 100. The function of this pump system is to pump liquids between process connections 98, 100. They are called input or outputs because this pump can be readily programmed to pump in either direction. Note that the connections between the manifold ports and the process are through couplings, identified as items 114 in the drawing figure. A mass flow meter 102 is disposed along port 99 to enable the controller 86 to monitor the mass of liquid being pumped by the system.

In FIG. 9, manifold ports 95 and 96 are coupled by couplers 114 to a first pump chamber 72 and a second pump chamber 74. The pump chambers are simple vessels having a given volume with a liquid coupling 114 at the lower end and a gas coupling 116 at the upper end. The first pump chamber 72 has a lower level detector 90 adjacent to its lower end and an upper level detector 88 adjacent to its upper end. Likewise, the second pump chamber 74 has a lower level detector 94 adjacent to its lower end and an upper level detector 92 adjacent to its upper end. All of the level detectors are coupled to the controller using the plural control lines 112. The level detectors are of the non-contact variety, such as capacitance level detectors, as are known to those skilled in the art. The gas couplings 116 at the upper ends of the pump chambers 72, 74, are coupled to respective micron filters 76, 78. The micron filters serve as a sterile barrier for the liquid in the pump chambers 72, 74. The micron filters 76, 78 are coupled by coupler 116 to a valve manifold 80.

The valve manifold 80 in FIG. 9 is configured to route either gas pressure 82 or vacuum 84 to either micron filter and pump chamber pair 72, 72 or 78, 74. In operation, vacuum is applied to a pump chamber, which draws liquid from one of the process interfaces, 98 or 100, through the flexible tubing manifold 96 and into that pump chamber. The various valve states are coordinated by the controller 86 to establish the needed routing for the liquid and gas. Similarly, when a pump chamber is filled with liquid, the valve manifold 80 routes gas pressure 82 to that pump chamber, which forces the liquid through the resilient tubing manifold and out the corresponding process interface 98 or 100. Note that a gas mass flow controller 103 is coupled to the gas pressure source and interfaced with the controller 86. This enables the controller to monitor the amount of gas that is consumed in moving liquid, which can be correlated to determine the volumetric performance of the pump system. It can be appreciated that the liquid contacts the resilient tubing manifold 96, the pump chambers 72, 74, and it is assumed that the liquid also contacts the sterilizing filters 76, 78, as well as their related couplings 114, 116. None of the other system components contact the liquid, so they need not be sanitized or replaced to maintain liquid purity, sanitation, or sterility.

Figure 10:
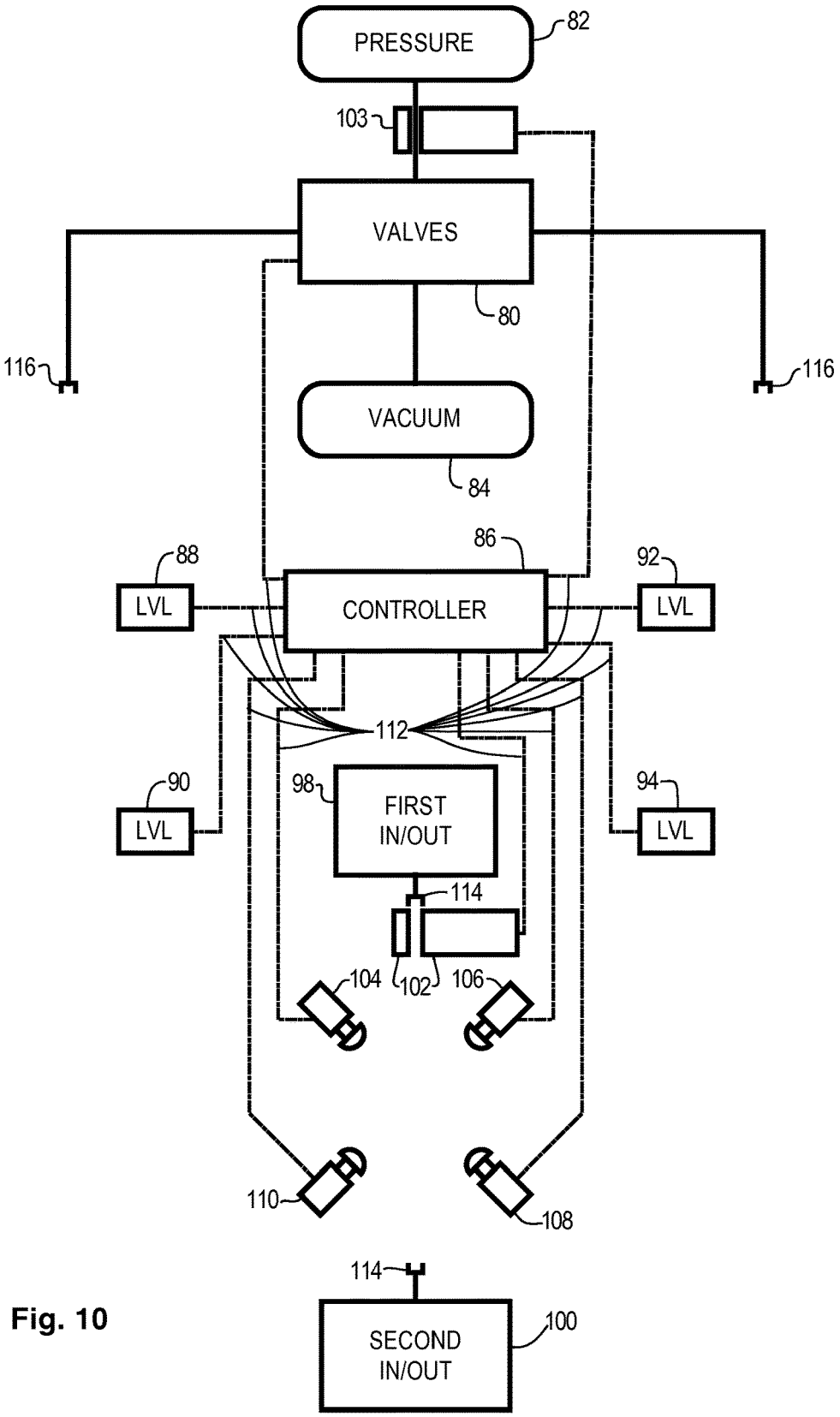
FIG. 10 is a functional block diagram of a pump with the single use elements removed according to an illustrative embodiment of the present invention.

Reference is directed to FIG. 10, which is a functional block diagram of a pump with the single use elements removed according to an illustrative embodiment of the present invention. FIG. 10 generally comports with FIG. 9. In FIG. 9, all of the elements of the pumping system, which contact the working liquid, and which might therefore be contaminated, have been removed. It is noteworthy to consider the remaining elements that interact with the working liquid, but do not need to be replaced by virtue of the design choices in this illustrative embodiment. Among these are the pinch actuators 104, 106, 108, 110, the mass liquid flow meter 102, the liquid level detectors 88, 90, 92, and 94, and the various aseptic connectors 114 and 116. Not further that the first and second process interfaces 98, 100 are not an element of the illustrative embodiment, and are therefore maintained in a sterile and uncontaminated condition by other means.

Figure 11:
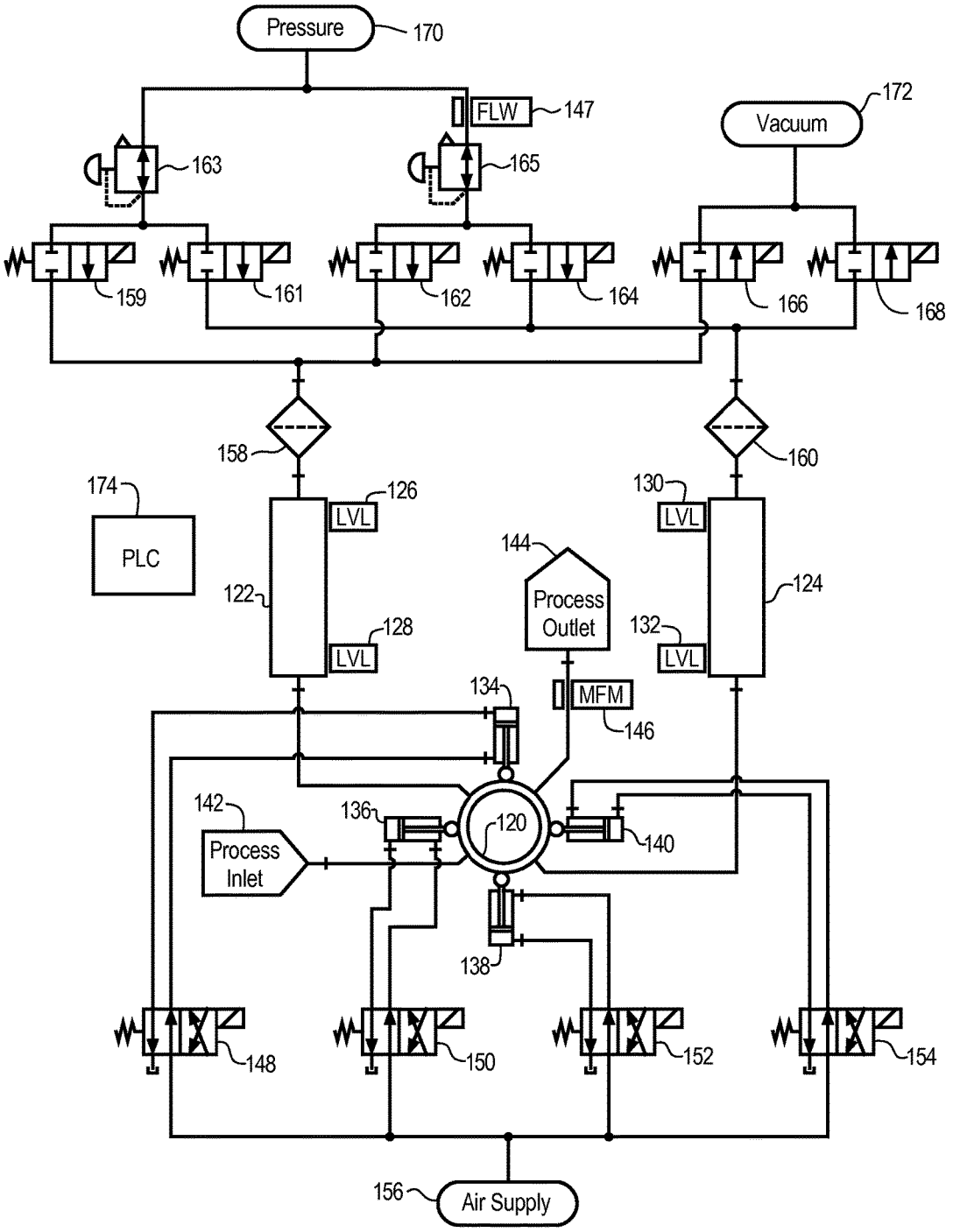
FIG. 11 is a schematic diagram of a pump according to an illustrative embodiment of the present invention.

Reference is directed to FIG. 11, which is a schematic diagram of a pump according to an illustrative embodiment of the present invention. This illustrative embodiment presents an example of specific valve implementations. This embodiment generally employs a pneumatic control system with solenoid operated pneumatic valves, which are under control of a PLC controller 174. The PLC 174 can also be interfaced to broader system controls, such as those employed in a manufacturing or distribution environment. An external gas pressure source 170 is coupled to two pairs of two-position two-way solenoid pneumatic valves 159 and 161, and, 162 and 164, such that gas pressure can be applied through two sets of valves to either pump chamber 122, 124 through their respective filters 158, 160. The gas pressure source 170 is coupled through two electronic pressure regulators 163 and 147 to respective pairs of solenoid valves 159, 161, and 162, 164 respectively. This provides precise pressure regulations for two functional used of the system gas pressure 170. The first function is for pre-charging the pump chambers 122, 124 through the solenoid valves 159 and 161. The second function is applying pumping pressure to the pump chambers 122, 124 through solenoid valves 162 and 164. Note that the gas pressure supply to valves 162 and 164 passes through a mass flow controller so that gas flow can be precisely measure. This information is used to calculate the volumetric liquid pumping performance of the pump. The pre-charging operation accomplished by valves 159 and 161 improves the accuracy of measurement during the pumping operation by removing pressure pulses that may adversely affect the mass flow controller 147. An external vacuum source 172 is coupled to another pair of two-position two-way solenoid pneumatic valves 166, 168, such that vacuum can be applied to evacuate either pump chamber 122, 124 through their respective filters 158, 160.

The liquid level detectors 126, 128, 130, and 132 in FIG. 11 are illustrated adjacent to their respective pump chambers 122, 124. The lower couplings on the pump chambers 122, 124 are coupled to opposing ports on a resilient tubing manifold 120. The other two opposing ports of the resilient tubing manifold 120 are coupled to a process inlet 142 and a process outlet 144, indicating that this illustrative embodiment is programmed to pump liquid from the process inlet 142 to the process outlet 144. Note that mass flow controller 147 is disposed along the gas pressure inlet line, as has been discussed hereinbefore.

The resilient tubing manifold 120 in FIG. 11 is positioned adjacent to four pinch actuators 134, 136, 138, and 140, which are all pneumatic cylinders in this illustrative embodiment. Any of these cylinders can be actuated to engage and pinch off flow between adjacent ports on the resilient tubing manifold 120, as illustrated. The motive force for the air cylinders is an external compressed air supply 156. Each of pneumatic cylinders 134, 136, 138, and 140 are controlled by a corresponding 2-position, 4-way, 4-ported solenoid-controlled pneumatic valve 148, 150, 152, 154, such that the PLC 174 is enabled to selectively actuate and de-actuate any of the four pinch valves. The valve sequencing is critical to operation of the pump, and will be more fully discussed hereinafter.

Figures 12, 13:
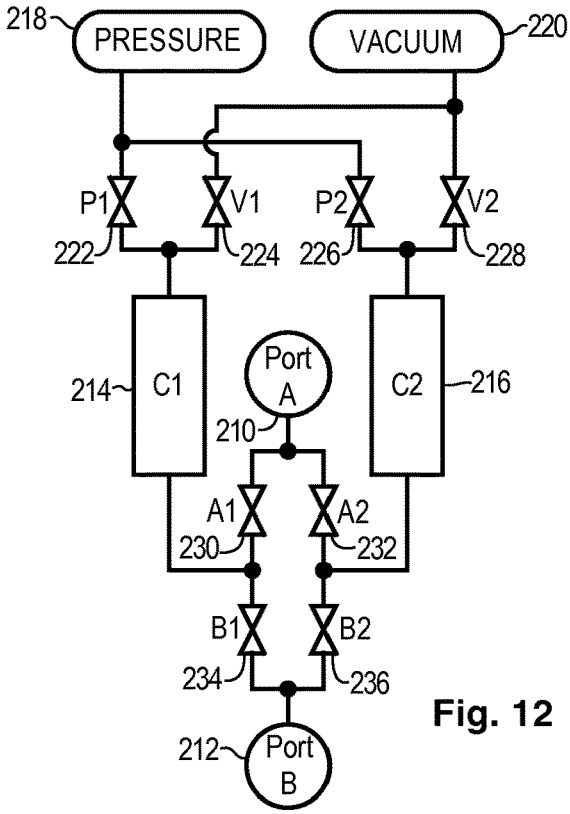
FIG. 12 is a schematic diagram of a pump according to an illustrative embodiment of the present invention.
FIG. 13 is a pump valve state table according to an illustrative embodiment of the present invention.

Reference is directed to FIG. 12, which is a schematic diagram of a pump according to an illustrative embodiment of the present invention. This diagram is presented for reference with respect to FIG. 13, where specific valve sequences will be presented. As such, FIG. 12 only presents the valves and pump chamber arrangement without other accoutrements that might be employed. The liquid transfer in FIG. 12 is between process port A 210 and port B 212. For this analysis, liquid flow in both directions between these ports 201, 212, will be discussed. The resilient tubing manifold is presented as four simple fluid valves A1 230, A2 232, B1 234, and B2 236. Note that the "A" and "B" valve designations correspond to the process port "A" and "B" designation for convenient reference. The interconnection to the pump chambers 214, 216 is according to the presented schematic. Also note the "C1" and "C2" chamber designations, which will be used as a reference in FIG. 13. The gas pressure source 218 and vacuum source 220 are interconnected to the upper ends of the pump chambers 214, 216 by four valves P1 222, P2 226, V1 224, and V2 228, as illustrated. Note the relationship between the use of "P" for pressure and "V" for vacuum. Also note the use of "1" and "2" in all the valve designations as corresponding to the pump chamber designations.

Reference is directed to FIG. 13, which is a pump valve state table according to an illustrative embodiment of the present invention. The letter-number designations in FIG. 13 comport with those in FIG. 12. The valve actuations are arranged in table form, where "X" indicates that a valve is closed, and "O" indicates a valve is open. The opening and closing operations are implemented by a controller (not shown). The vertical columns of the table, from left to right, comprise the following information. Column 240 is the System Operation mode for each row of the table, and these include: an OFF operation 246; a C1 Fill/C2 Pump 248 with either A Outlet or B Outlet; a C1 Pump/C2 Fill 250 with either A Outlet or B Outlet; and a Service/Replace mode 256. The next column 242 is presents the Pressure and Vacuum valve states, and the final column 244 presented the Liquid Flow Valve states. To a large extent, this table is intended to be self-explanatory. However, consider some specifics to enhance understanding. The OFF mode 246 simply closes all the valves P1, V1, P2, V2. A1, B1, A2, and B2. It is evident that in this mode, no gas or vacuum flows and no liquid moves through the manifold. Similarly, the Service Replace mode 252 closes all the pressure and vacuum valves so that no motive force is applied to the chambers C1 an C2. However, the pinch actuator valves A1, B1, A2, and B2 are all open so that resilient tubing manifold can be replaced.

The operational modes of the pump reside in rows 248 and 250, where the chambers C1 ands C2 are filled with liquid (C1 or C2 Fill) or where liquid is pumped out (C1 or C2 pump). In order to implement a continuous flow, the states indicated in row 248 and 250 must be alternated between over time, as indicated by "Alternate" arrow 254. The controller (not shown) implements this alternation by relying on the liquid level sensors (not shown). Since the pump is enabled to pump in either direction, the sections of rows 248 and 250 that are labeled "A Outlet" and "B Outlet" present opposite valve states, as would be expected to reverse the direction of flow. In order for this to function correction, both of row 248 and 250 must employ the same corresponding valve state for the outlet direction sought.

Figure 14:
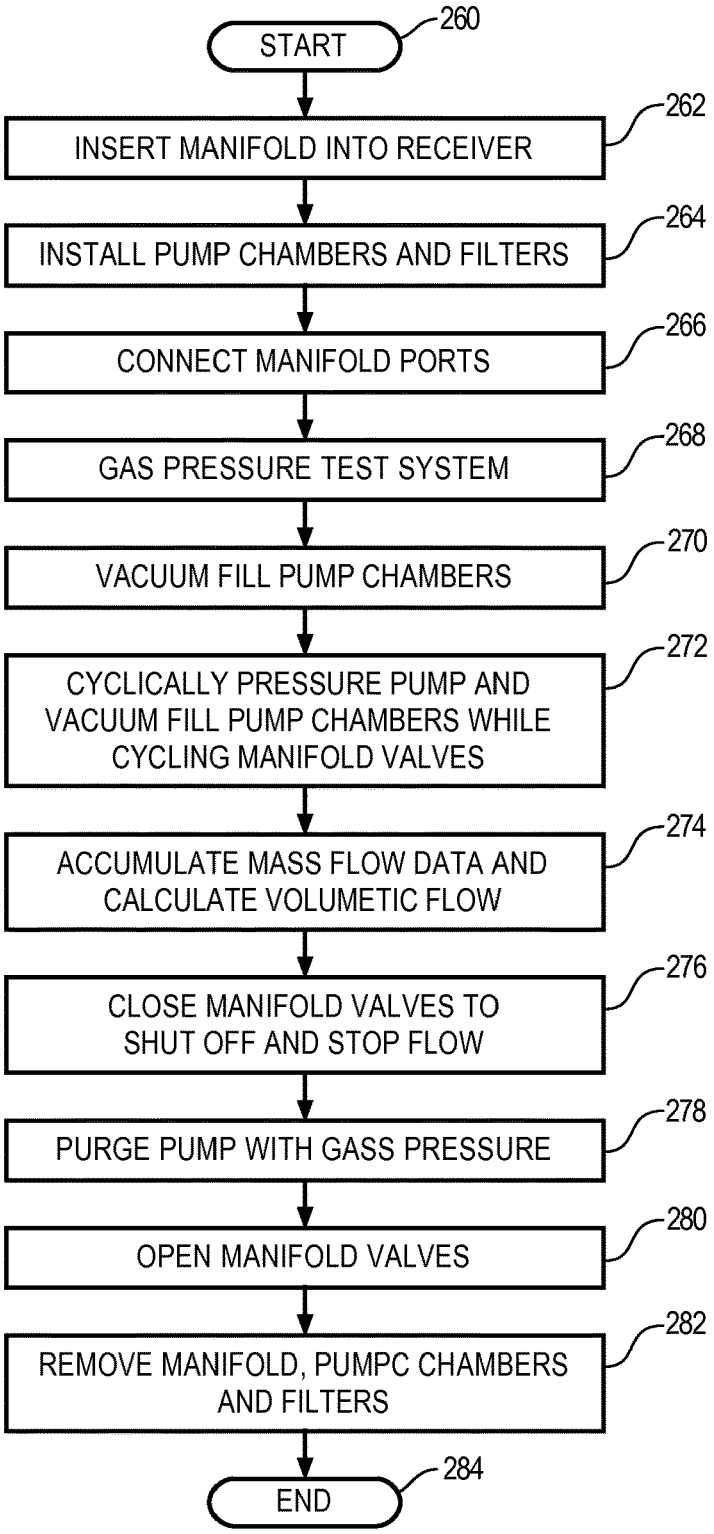
FIG. 14 is a process flow diagram according to an illustrative embodiment of the present invention.

Reference is directed to FIG. 14, which is a process flow diagram according to an illustrative embodiment of the present invention. The process begins at step 260 and proceeds to step 262 where a resilient tubing manifold is inserted into the manifold receiver. At step 264, the pump chambers and micron filters are inserted into the pump assembly. At step 266, all the manifold ports are connected. At step 268, a gas pressure tests is conducted. At step 270, vacuum is applied to both pump chambers so as to draw them full of process liquid. At step 272, pumping is commenced by alternatingly applying pressure and vacuum to the pump chambers while correspondingly cycling the manifold vales to route the flow of liquid. At step 274, mass flow data is accumulated by the mass flow meters and used to calculate volumetric flow. At step 276, the manifold valves are all closed to shut off flow through the pump. At step 278, the pump chambers are purged using gas pressure. At step 280, the resilient tubing manifold valves are all opened so that the resilient tubing manifold can be removed at step 282. The process ends at step 284.

Figure 15:
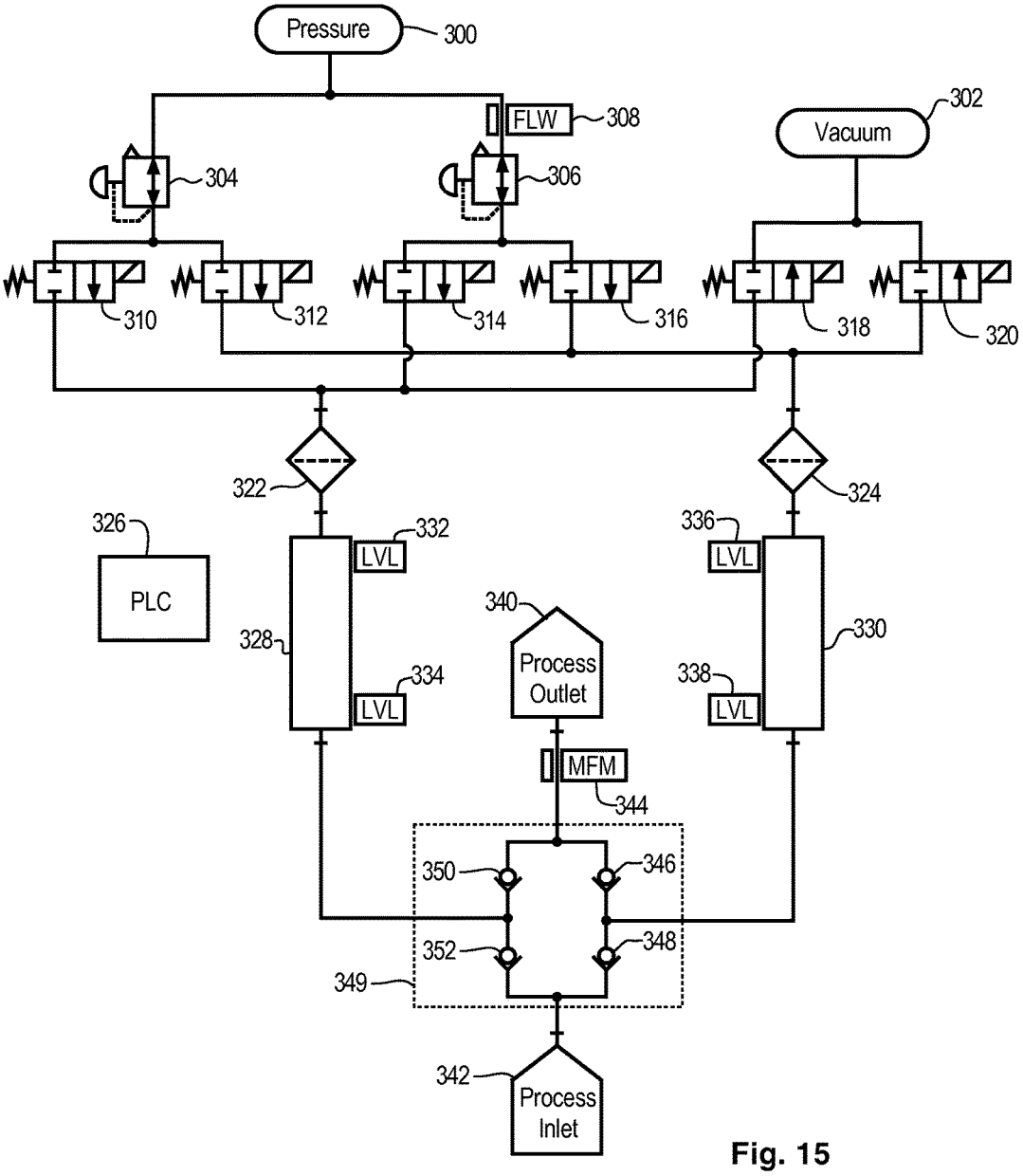
FIG. 15 is a schematic diagram of a pump according to an illustrative embodiment of the present invention.

Reference is directed to FIG. 15, which is a schematic diagram of a pump according to an illustrative embodiment of the present invention. This illustrative embodiment presents an example of specific valve implementations. This embodiment generally employs a pneumatic control system with solenoid operated pneumatic valves, which are under control of a PLC controller 326. The PLC 326 can also be interfaced to broader system controls, such as those employed in a manufacturing or distribution environment. An external gas pressure source 300 is coupled to two pairs of two-position two-way solenoid pneumatic valves 310 and 312, and, 314 and 316, such that gas pressure can be applied through two sets of valves to either pump chamber 328, 330 through their respective filters 322, 324. The gas pressure source 300 is coupled through two electronic pressure regulators 304 and 306 to respective pairs of solenoid valves 310, 312, and 314, 316 respectively. This provides precise pressure regulations for two functional uses of the system gas pressure 300. The first function is for pre-charging the pump chambers 328, 330 through the solenoid valves 310 and 312. The second function is applying pumping pressure to the pump chambers 328, 330 through solenoid valves 314 and 316. Note that the gas pressure supply to valves 314 and 316 passes through a mass flow controller 308 so that gas flow can be precisely measure. This information is used to calculate the volumetric liquid pumping performance of the pump. The pre-charging operation accomplished by valves 310 and 312 improves the accuracy of measurement during the pumping operation by removing pressure pulses that may adversely affect the mass flow controller 308. An external vacuum source 302 is coupled to another pair of two-position two-way solenoid pneumatic valves 318, 320, such that vacuum can be applied to evacuate either pump chamber 328, 330 through their respective filters 322, 324.

The liquid level detectors 332, 334, 336, and 338 in FIG. 15 are illustrated adjacent to their respective pump chambers 328, 330. The lower couplings on the pump chambers 328, 330 are coupled to opposing ports on a liquid manifold 349. The other two opposing ports of the liquid manifold 349 are coupled to a process inlet 342 and a process outlet 340.

The liquid manifold 349 in FIG. 15 includes four check valves 350, 352, 346, and 348, which are oriented to direct liquid flow only from the process inlet 342 to the process outlet 340. Liquid can be forced into the liquid manifold 349 from either of the pump cylinders 328 or 330, between the respective pairs of check valves 350 and 352, and 346 and 348. This arrangement ensures that the desired process flow is always from the process inlet 342 to the process outlet 340.

Figure 16:
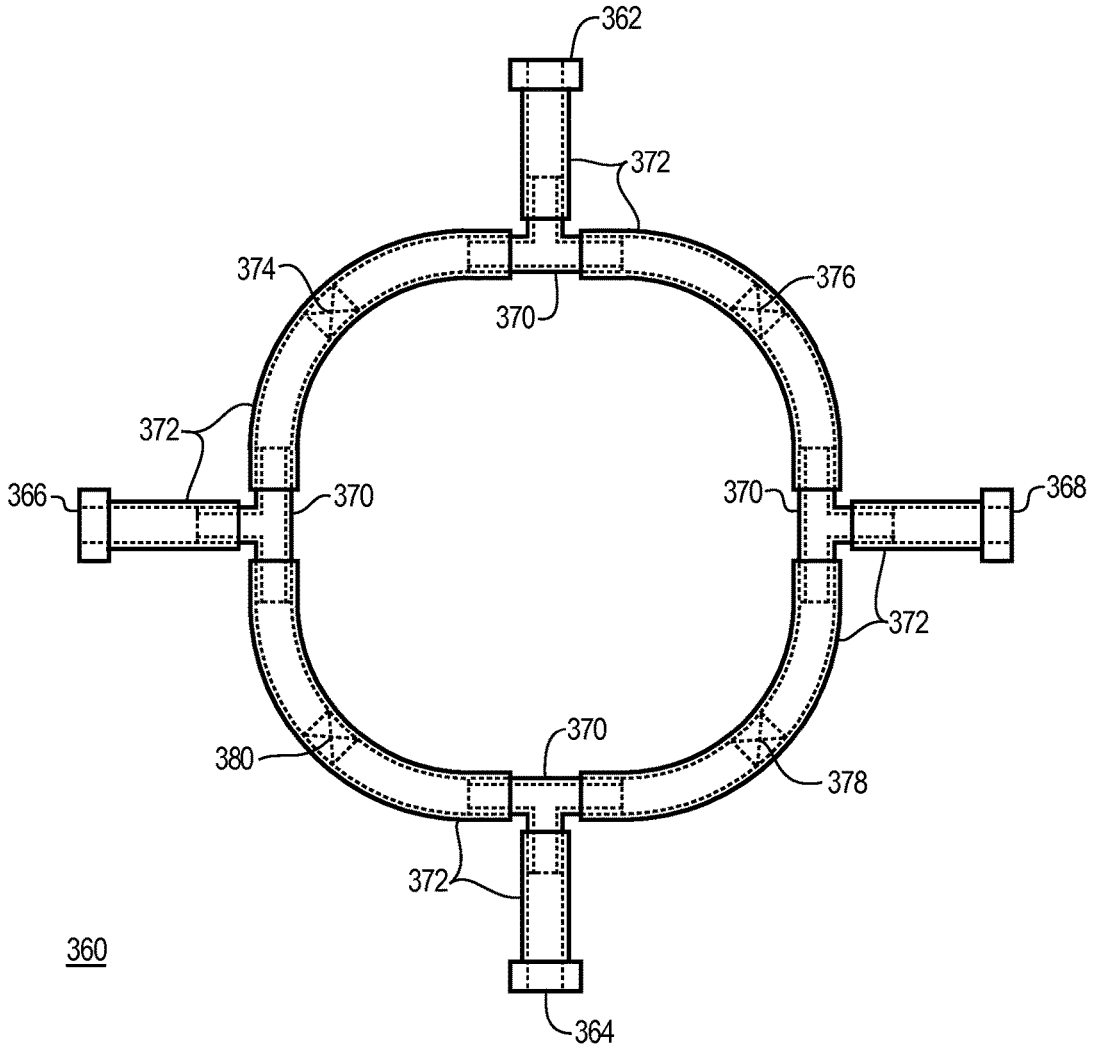
FIG. 16 is a top view drawing of a liquid manifold according to an illustrative embodiment of the present invention.

Reference is directed to FIG. 16, which is a top view drawing of a liquid manifold 360 according to an illustrative embodiment of the present invention. Resilient polymeric tubing 372 is employed to fabricate the manifold 360 because of its low cost, flexibility, ease of use, and because there is a wide range of polymers available that can suit nearly every chemical or physical requirement encountered by designers. In the illustrative embodiment, polymeric tee fittings 370 are used in the manifold 360 to attach the port connections 362, 364, 366, and 368. Since this manifold is a portion of the one-time use components of the pump, low cost is a highly desirable characteristic. In this embodiment, the check valves 374, 376, 378, and 380 are inserted into the tubing 372 to provide a clean and simple design. Insertable check valves are available from several suppliers, and one example is Series 100, Model 170 Standard Cartridge ¾" smooth body check valves, which are available from Smart Products, which has an Internet web site located at: http://www.smartproducts.com. Of course conventional check valves with hose fitting could also be employed, as well as other check valves as are known to those skilled in the art. The port connections 362, 364, 366, and 368 may be aseptic fittings, for example, or may be conventional Tri-Clover fittings, or other suitable fittings to match the system requirements or that are otherwise known to those skilled in the art.

Figures 17, 18:
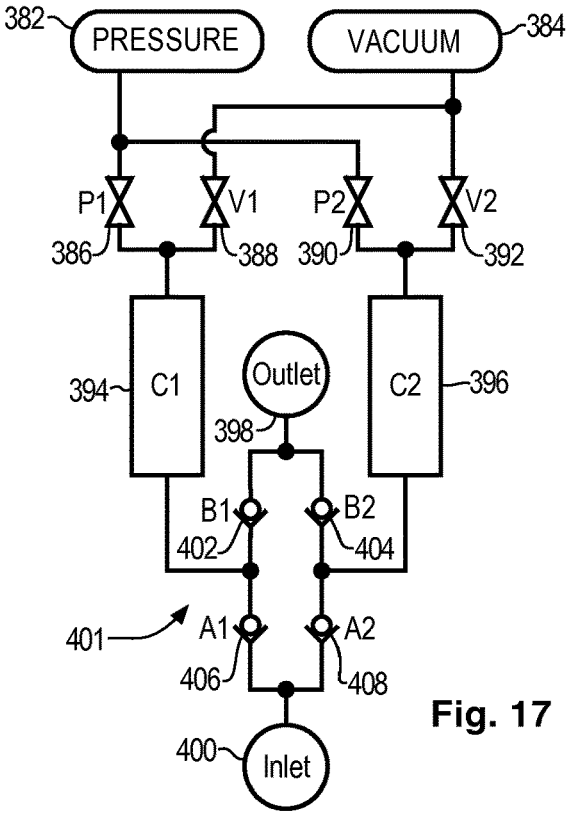
FIG. 17 is a schematic diagram of a pump according to an illustrative embodiment of the present invention.
FIG. 18 is a gas valve state table according to an illustrative embodiment of the present invention.

Reference is directed to FIG. 17, which is a schematic diagram of a pump according to an illustrative embodiment of the present invention. This diagram is presented for reference with respect to FIG. 18, where specific valve sequences will be presented. As such, FIG. 17 only presents the valves and pump chamber arrangement without other accoutrements that might be employed in a particular embodiment. The liquid transfer in FIG. 17 is from process inlet port 400 to process outlet port 398. The liquid manifold 401 is presented with four check valves B1 402, B2 404, A1 406, and A2 408. Note that the "A" and "B" check valve designations correspond to the process ports inlet "A" and outlet "B" designation for convenient reference. The interconnection to the pump chambers 394, 396 is according to the presented schematic. Also note the "C1" and "C2" chamber designations, which will be used as a reference in FIG. 18. The gas pressure source 382 and vacuum source 384 are interconnected to the upper ends of the pump chambers 394, 396 by four valves P1 386, P2 390, V1 388, and V2 392, as illustrated. Note the relationship between the use of "P" for pressure and "V" for vacuum. Also note the use of "1" and "2" in all the valve designations as corresponding to the pump chamber designations. In operation, a controller (not shown) actuates these valves to implement the movement of liquid under gas pressure and vacuum within the chambers 394, 396, and directionally routed by the check valves 402, 404, 406, and 408 in the liquid manifold 401.

Reference is directed to FIG. 18, which is a pump valve state table according to an illustrative embodiment of the present invention. The letter-number designations in FIG. 18 comport with those in FIG. 17. The valve actuations are arranged in table form, where "X" indicates that a valve is closed, and "O" indicates a valve is open. The opening and closing operations are implemented by a controller (not shown). The vertical columns of the table, from left to right, comprise the following information. Column 410 is the System Operation mode for each row of the table, and these include: an OFF operation 416; a C1 Fill/C2 Pump operation 418; and a C1 Pump/C2 Fill 420. To a large extent, this table is intended to be self-explanatory. However, consider some specifics to enhance understanding. The OFF mode 416 simply closes all the valves P1, V1, P2, V2. It is evident that in this mode, no gas or vacuum flows and no liquid moves through the manifold.

The operational modes of the pump reside in rows 418 and 420, where the chambers C1 ands C2 are filled with liquid (C1 or C2 Fill) or where liquid is pumped out (C1 or C2 pump). In order to implement a continuous flow, the states indicated in row 418 and 420 must be alternated between over time, as indicated by "Alternate" arrow 422. The controller (not shown) implements this alternation by relying on the liquid level sensors (not shown). The operation of the check valves A1, B1, A2, and B2 are implemented by differential pressure caused by the actuation of the gas and vacuum valves P1, V1, P2, and V2.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

What is claimed is:

1. A gas pressure and vacuum driven pump apparatus for pumping a liquid from a liquid inlet coupling to a liquid outlet coupling of an external process, said apparatus comprising:

a first pump chamber having a first gas coupling and a first liquid coupling;

a second pump chamber having a second gas coupling and a second liquid coupling;

a gas valve assembly coupled to selectively communicate gas pressure or vacuum with said first gas coupling and said second gas coupling;

a liquid manifold, which comprises a liquid inlet port for connection to the liquid inlet coupling and a liquid outlet port for connection to the liquid outlet coupling, said liquid inlet port directionally coupled to a first liquid port by a first inlet valve and directionally coupled to a second liquid port by a second inlet valve, and wherein said first liquid port is directionally coupled to said liquid outlet port by a first outlet valve, and wherein said second liquid port is directionally coupled to said liquid outlet port by a second outlet valve, and wherein said first liquid port is coupled to said first liquid coupling and said second liquid port is coupled to said second liquid coupling;

a controller programmed to actuate said gas valve assembly to cycle and alternatingly couple gas pressure or vacuum to said first gas coupling and said second gas coupling such that one of said first and second pump chambers is pressurized while another of the first and second pump chambers is evacuated, and wherein vacuum applied to said first pump chamber draws liquid from the liquid inlet coupling, through said liquid inlet port, through said first inlet valve, through said first liquid port and into said first pump chamber, while gas pressure coupled to said second pump chamber pushes liquid out of said second pump chamber, through said second liquid port, through said second outlet valve, out said liquid outlet port, and into the liquid outlet coupling, and alternatingly, vacuum applied to said second pump chamber draws liquid from the liquid inlet coupling, through said liquid inlet port, through said second inlet valve, through said second liquid port, and into said second pump chamber, while gas pressure coupled to said first pump chamber pushes liquid out of said first pump chamber, through said first liquid port, through said first outlet valve, out said liquid outlet port, and into the liquid outlet coupling, to thereby effect a flow of the liquid from the liquid inlet coupling to the liquid outlet coupling, and wherein said liquid manifold is fabricated from round elastomeric tubing with said first and second liquid ports, and said liquid inlet port and said liquid outlet port extending outward therefrom, and wherein said first and second inlet valves and said first and second outlet valves are disposed along said tubing at locations between adjacent ports of the liquid inlet port, the first liquid port, the liquid outlet port and the second liquid port, respectively.

2. The apparatus of claim 1, and wherein:

said controller is further programmed to operate said gas valve assembly to pre-charge said first pump chamber and said second pump chamber with gas pressure prior to each cycle of said controller to alternatingly couple gas pressure and vacuum to said first pump chamber and said second pump chamber.

3. The apparatus of claim 2, further comprising:

a gas pressure regulator coupled with said gas valve assembly to deliver regulated gas pressure to pre-charge said first pump chamber and said second pump chamber.

4. The apparatus of claim 1, further comprising:

at least a first micron filter, which is a sterilization grade filter, that is coupled between said first gas coupling and said gas valve assembly, thereby sterilely isolating said first pump chamber from said gas valve assembly.

5. The apparatus of claim 1, wherein said first and second pump chambers are oriented vertically with said first and second gas couplings located at an upper end, and said first and second liquid couplings located at a bottom end of said first and second pump chambers, respectively, and further comprising:

an upper level detector and a lower level detector positioned adjacent to the upper end and lower end, respectively, of each of said first and second pump chambers to thereby sense a level of the liquid therein and generate a liquid level signal, and wherein said level detectors are coupled to provide said liquid level signals to said controller, and wherein said controller is programmed to alternate said gas pressure and vacuum to said first and second pump chambers, and to alternate gas pressure and vacuum delivered to said first and second pump chambers according to said liquid level signals, to thereby prevent over filling and under filling of said first and second pump chambers.

6. The apparatus of claim 1, and wherein said first and second inlet valves and said first and second outlet valves are check valves.

7. The apparatus of claim 6, and wherein:

said first and second inlet valves and said first and second outlet valves are inserted into said tubing.

8. The apparatus of claim 1, further comprising:

a flow meter disposed adjacent to said liquid outlet port, which provides a volumetric flow signal, and wherein said volumetric flow signal is coupled to said processor, and wherein said processor accumulates said volumetric flow signal to produce an accumulated liquid volume signal.

9. The apparatus of claim 1, further comprising:

a gas flow meter coupled with said gas valve assembly, which provides a gas flow signal, and wherein said gas flow signal is coupled to said controller, and wherein said controller calculates a volume of liquid pumped based on said gas flow signal to produce a liquid flow signal.

10. The apparatus of claim 1, and wherein:

said controller is programmed to actuate said gas valve assembly to deliver gas pressure to both of said first and second pump chambers, thereby enabling a pressure test of said first and second pump chambers and said tubing manifold.

11. The apparatus of claim 1, further comprising:

plural aseptic connectors that terminate said first and second gas couplings, said first and second liquid couplings, said first and second liquid ports, and said liquid inlet and outlet ports.

12. A method of pumping a liquid between a liquid inlet coupling and a liquid outlet coupling of an external process utilizing gas pressure and vacuum in a pump consisting of a first pump chamber with a first gas coupling and a first liquid coupling, and a second pump chamber with a second gas coupling and a second liquid coupling, and a gas valve assembly coupled to a controller, and a liquid manifold having a liquid inlet port and a liquid outlet port wherein the liquid inlet port is directionally coupled to a first liquid port by a first inlet valve and directionally coupled to a second liquid port by a second inlet valve, and wherein the first liquid port is directionally coupled to the liquid outlet port by a first outlet valve, and wherein the second liquid port is directionally coupled to the liquid outlet port by a second outlet valve, the method comprising the steps of:

connecting the first pump chamber and the second pump chamber to the gas valve assembly, and coupling the liquid manifold to the pump by connecting the liquid inlet port to the liquid inlet coupling, connecting the liquid outlet port to the liquid outlet coupling, connecting the first liquid port to the first liquid coupling, and connecting the second liquid port to the second liquid coupling;

controlling the gas valve assembly, by the controller, to alternatingly couple gas pressure or vacuum to the first gas coupling and the second gas coupling thereby pressurizing one of the first and second pump chambers while evacuating another of the first and second pump chambers, and thereby drawing liquid from the liquid inlet coupling, through the liquid inlet port, through the first inlet valve, through the first liquid port and into the first pump chamber by applying vacuum to the first pump chamber, while pushing liquid out of the second pump chamber, through the second liquid port, through the second outlet valve, out the liquid outlet port, and into the liquid outlet coupling by applying gas pressure to the second pump chamber, and alternatingly applying vacuum to the second pump chamber, thereby drawing liquid from the liquid inlet coupling, through the liquid inlet port, through the second inlet valve, through the second liquid port, and into the second pump chamber, while applying gas pressure to the first pump chamber, thereby pushing liquid out of the first pump chamber, through the first liquid port, through the first outlet valve, out the liquid outlet port, and into the liquid outlet coupling, and thereby effecting a continuous flow of the liquid from the liquid inlet coupling to the liquid outlet coupling, and fabricating the liquid manifold from round elastomeric tubing with the first and second liquid ports, and the liquid inlet port and the liquid outlet port extending outward therefrom, and disposing the first and second inlet valves and the first and second outlet valves along the tubing at locations between adjacent ports of the liquid inlet port, the first liquid port, the liquid outlet port and the second liquid port, respectively.

13. The method of claim 12, further comprising the step of:

selectively operating the valve assembly to pre-charge the first pump chamber and the second pump chamber with gas pressure prior to each cycle of said step of controlling the gas valve assembly to alternate gas pressure and vacuum.

14. The method of claim 12, further comprising the steps of:

coupling at least a first micron filter, which is a sterilization grade filter, between the first gas coupling and the gas valve assembly, thereby sterilely isolating the first pump chamber from the gas valve assembly.

15. The method of claim 12, wherein the first and second pump chambers are oriented vertically with the first and second gas couplings located at the upper end, and the first and second liquid couplings located at the bottom end of the first and second pump chambers, respectively, and further including an upper level detector and a lower level detector positioned adjacent to the upper end and lower end, respectively, of each of the first and second pump chambers, thereby sensing a level of the liquid therein, and generating a liquid level signal, the method further comprising the steps of:

alternating the gas pressure and vacuum coupled to the first and second pump chambers according to the liquid level signal, thereby preventing over filling and under filling of the first and second pump chambers.

16. The method of claim 15, and wherein a mass flow meter is disposed adjacent to the liquid outlet coupling, which provides a volumetric flow signal, the method further comprising the steps of:

accumulating said volumetric flow signal into an accumulated liquid volume signal by the controller.

17. The method of claim 15, and wherein a gas flow meter is coupled with the gas valve assembly for providing a gas flow signal, the method further comprising the step of:

calculating, by the controller, a volume of liquid pumped based on the gas flow signal, and thereby producing a correlated liquid flow signal.

18. The method of claim 12, and further comprising the steps of:

actuating the gas valve assembly to deliver gas pressure to both of the first and second pump chambers, thereby enabling a pressure test of the first and second pump chambers and the liquid manifold.

* * * * *